US010315902B2

(12) United States Patent
Xu

(10) Patent No.: US 10,315,902 B2
(45) Date of Patent: Jun. 11, 2019

(54) VEHICLE WITH A LOW GRAVITY CENTER AND AERIAL WORK PLATFORM

(71) Applicant: Zhejiang Dingli Machinery Co., LTD, Zhejiang (CN)

(72) Inventor: Shugen Xu, Zhejiang (CN)

(73) Assignee: Zhejiang Dingli Machinery Co., LTD (CN)

( * ) Notice: Subject to any disclaimer, the term of this patent is extended or adjusted under 35 U.S.C. 154(b) by 33 days.

(21) Appl. No.: 15/647,591

(22) Filed: Jul. 12, 2017

(65) Prior Publication Data

US 2018/0057332 A1 Mar. 1, 2018

(30) Foreign Application Priority Data

Aug. 31, 2016 (CN) ..... 2016 1 0778675

(51) Int. Cl.

| | |
|---|---|
| ***B66F 17/00*** | (2006.01) |
| ***B66C 23/70*** | (2006.01) |
| ***B66F 9/075*** | (2006.01) |
| ***B66F 11/04*** | (2006.01) |
| ***A62B 35/00*** | (2006.01) |
| ***B66F 7/04*** | (2006.01) |
| ***B66F 7/22*** | (2006.01) |
| *B66F 7/28* | (2006.01) |
| *B66F 13/00* | (2006.01) |

(52) U.S. Cl.

CPC ..... *B66F 17/006* (2013.01); *A62B 35/0075* (2013.01); *B66C 23/705* (2013.01); *B66F 7/04* (2013.01); *B66F 7/22* (2013.01); *B66F 9/07513* (2013.01); *B66F 11/046* (2013.01); *B66F 7/28* (2013.01); *B66F 13/00* (2013.01)

(58) Field of Classification Search

CPC ..... B66F 17/006; B66F 11/046

See application file for complete search history.

(56) References Cited

U.S. PATENT DOCUMENTS

| | | | | | |
|---|---|---|---|---|---|
| 3,856,108 | A * | 12/1974 | Grove | B66F 11/046 | 182/16 |
| 4,775,029 | A * | 10/1988 | MacDonald | B66F 11/046 | 182/2.1 |
| 5,021,917 | A * | 6/1991 | Pike | B66F 11/046 | 182/2.11 |
| 5,743,149 | A * | 4/1998 | Cullity | B66F 11/046 | 212/348 |

* cited by examiner

*Primary Examiner* — Alvin C Chin-Shue
(74) *Attorney, Agent, or Firm* — Lerner, David, Littenberg, Krumholz & Mentlik, LLP

(57) ABSTRACT

The present invention relates to the field of engineering mechanics and more particularly, relates to an engineering work vehicle, and most particularly, relates to a vehicle with a low gravity center and aerial work platform. The vehicle includes a vehicle frame, a power system, a fuel tank, and a hydraulic tank all of which are mounted at a side of the frame. Correspondingly, the embodiment of the invention also provides an aerial work platform which provides better off-road performance and grade-ability, can work in complicated environment, and owns a longer horizontal reach and larger working range. Moreover, maintenance and repair cost is decreased, lifetime is extended, integrity is higher and appearance looks better.

5 Claims, 14 Drawing Sheets

VEHICLE WITH A LOW GRAVITY CENTER AND AERIAL WORK PLATFORM

CROSS REFERENCE TO RELATED APPLICATIONS

The present application claims priority from Chinese Patent Application No. 201610778675.8 filed Aug. 31, 2016, all of which are hereby incorporated herein by reference.

FIELD OF THE INVENTION

The present invention relates to field of engineering mechanics and more particularly, relates to an engineering work vehicle, and most particularly, relates to a vehicle with a low gravity center and aerial work platform.

BACKGROUND OF THE INVENTION

Aerial work platform is an advanced aerial working mechanical device, and is capable of significantly improving efficiency, safety, and comfort of operators at height, and is also capable of reducing labor. Accordingly, it is widely employed in developed countries. This aerial work platform is also extensively used in China in many fields such as urban street lamp maintenance, tree trimming or the like. With rapid development of Chinese economy, aerial work platform is increasingly required in many situations such as engineering construction, industry installation, equipment repair, workshop maintenance, ship manufacture, electric power, municipal construction, airport, communications, city park, and transportation.

In a conventional aerial work platform, an engine, fuel tank and hydraulic tank are all laterally mounted on a turret. However, as the turret is disposed on a vehicle frame of the vehicle, a relatively high gravity center is resulted for the vehicle. This restricts off-road ability and grade-ability of the aerial work platform. In addition, this also restricts horizontal reach of the aerial work platform. In other words, the horizontal reach of an operation platform is limited.

However, the aerial work platform often runs in a complicated environment and accordingly, it is required to make some improvement upon structure and/or installation manner of relevant components of the vehicle. Therefore, there is need for providing an aerial work platform to overcome drawbacks of above prior art aerial work platform.

SUMMARY OF THE INVENTION

An object of the present invention is to address above problems and provide a vehicle with a low gravity center and aerial work platform. In current invention, power system, fuel tank and hydraulic tank are mounted at a side of a vehicle frame of a vehicle to lower gravity center of the vehicle and entire aerial work platform, enhance off-road capability and grade-ability of the aerial work platform, and increase horizontal reach of the aerial work platform, thereby enlarging working range of the aerial work platform.

To realize this object, the present invention proposes a vehicle with a low gravity center for an aerial work platform. The vehicle includes a vehicle frame, a power system, a fuel tank, and a hydraulic tank all of which are mounted at a side of the frame.

Specifically, the power system, fuel tank, and hydraulic tank are all disposed at a side of the vehicle frame along a length direction.

Furthermore, a first box and a second box are installed on two sides of the frame along the length direction of the frame respectively. The power system is contained in the first box, whereas the fuel tank and hydraulic tank are contained in the second box.

Specifically, the power system includes an engine located in the first box and secured onto the vehicle frame through a bracket.

Preferably, a damping device is disposed at a location where the engine and bracket are connected together.

Preferably, the fuel tank, hydraulic tank, and second box are integrally formed.

Furthermore, a control box is disposed on the second box and is foldable into and out of the second box.

Furthermore, the power system further includes a cooling component, a fuel delivery component, and an intake-exhaust component.

Correspondingly, the present invention further provides an aerial work platform including a vehicle with lower gravity center as mentioned above, a telescopic transmission component pivotablly mounted on the vehicle, and an operation platform disposed on a distal end of the telescopic transmission component.

Furthermore, a turret is disposed on the vehicle frame of the vehicle. One end, away from the operation platform, of the telescopic transmission component, is pivotablly connected with the turret through a supporting arm. The operation platform is connected with the telescopic transmission component via a telescopic connection component. A supporting member is disposed between the supporting arm and telescopic transmission component, and similarly, another supporting member is placed between the telescopic transmission component and telescopic connection component.

Compared with prior art techniques, the present invention brings the following good effects:

In present invention, as the power system, fuel tank, and hydraulic tank are all located at one side of the vehicle frame, and the total weight of these and other related components amounts to 1000 Kg-1500 Kg after injection of related materials, the gravity center of the aerial work platform is able to be lowered by 0.4 m-0.6 m, thus strongly improving off-road performance and grade-ability of the entire platform. Accordingly, the aerial work platform is able to run under various complex environments. In addition, the horizontal reach of the aerial work platform is also increased, and work range of the same is also extended.

Correspondingly, the power system is disposed in the first box, while the fuel tank and hydraulic tank is disposed in the second box. The first and second boxes are able to protect relevant components therein effectively, avoiding collision of these components with external objects and thereby avoiding damages to the same. This also decreases dust and aging of the components and therefore, further reduces cost of maintenance and repair, and extends life of the components. Moreover, as a damping device is provided between the engine and bracket, damage to the engine due to vehicle shake during running of the aerial work platform is effectively prevented, thus further reducing cost of maintenance and repair, and extending life of the components. Moreover, as the fuel tank, hydraulic tank, and second box are integrally formed, manufacture and installation is convenient, the entire construction is simple and compact, and appearance is good.

In a summary, the inventive aerial work platform has better off-road performance and grade-ability, can work in complicated environment, and owns a longer horizontal reach and larger working range. Moreover, maintenance and repair cost is decreased, lifetime is extended, integrity is higher and appearance looks better.

DETAILED DESCRIPTION OF THE INVENTION

Figure 1:
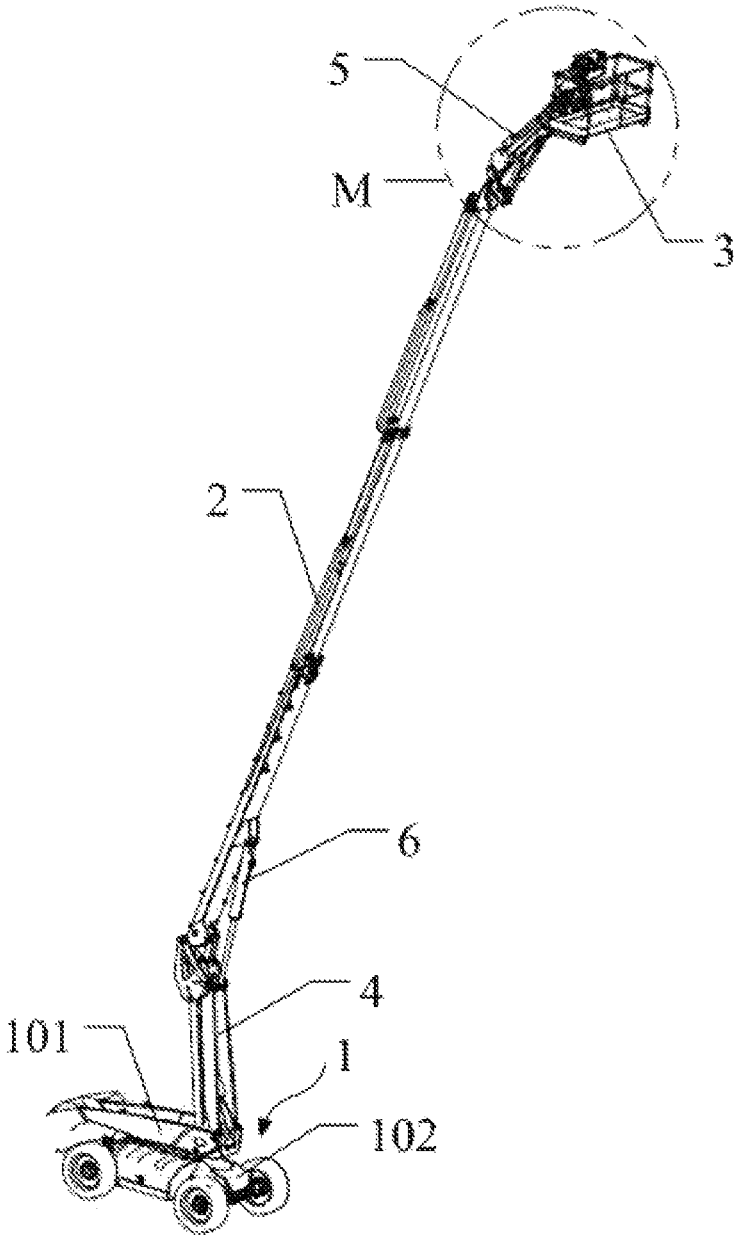
FIG. 1 shows a schematic view of an aerial work platform in accordance with a typical embodiment of the invention.
Figure 2:
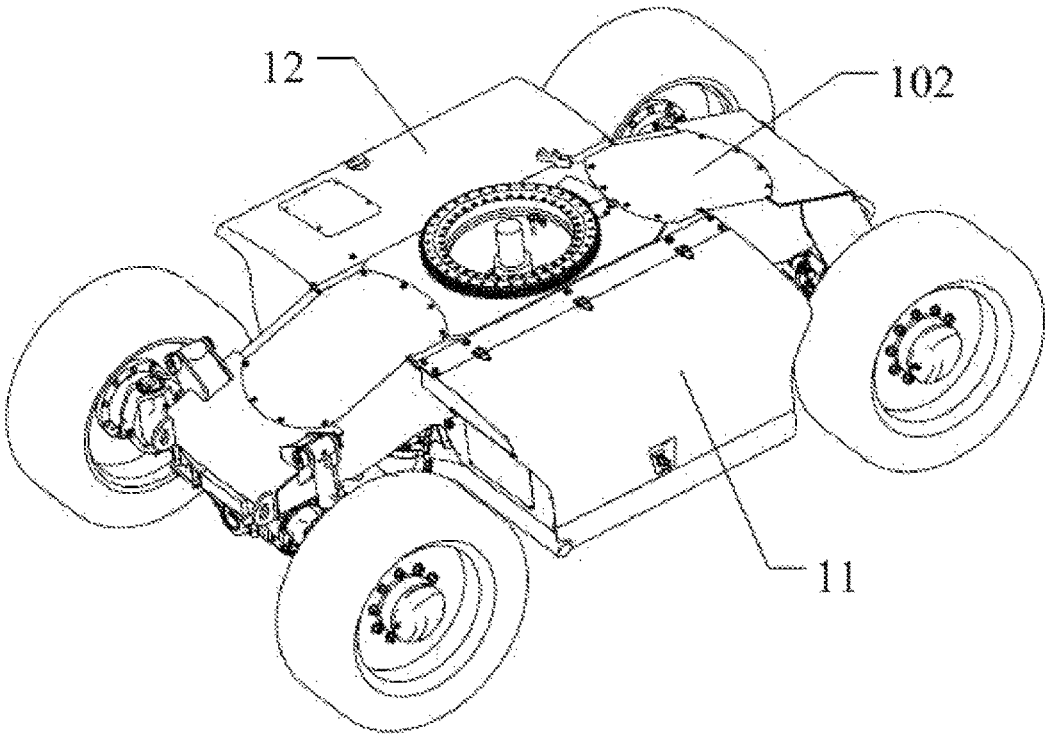
FIG. 2 shows a view of a vehicle of FIG. 1.
Figure 3:
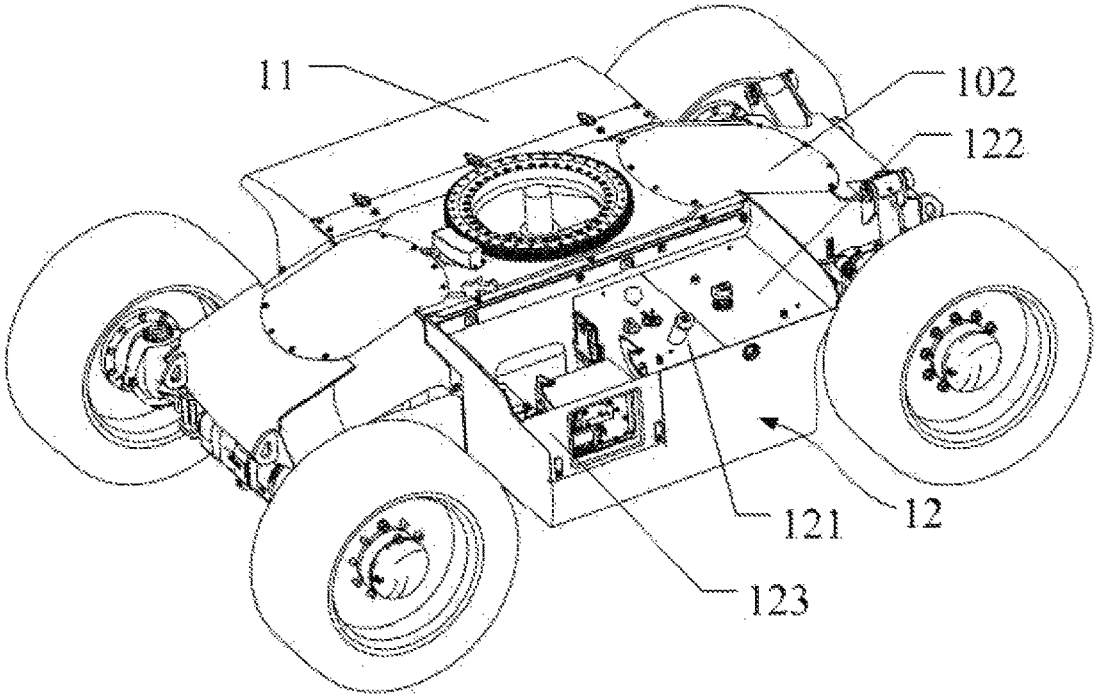
FIG. 3 illustrates another view of the vehicle of FIG. 1 showing internal construction of a second box.
Figure 4:
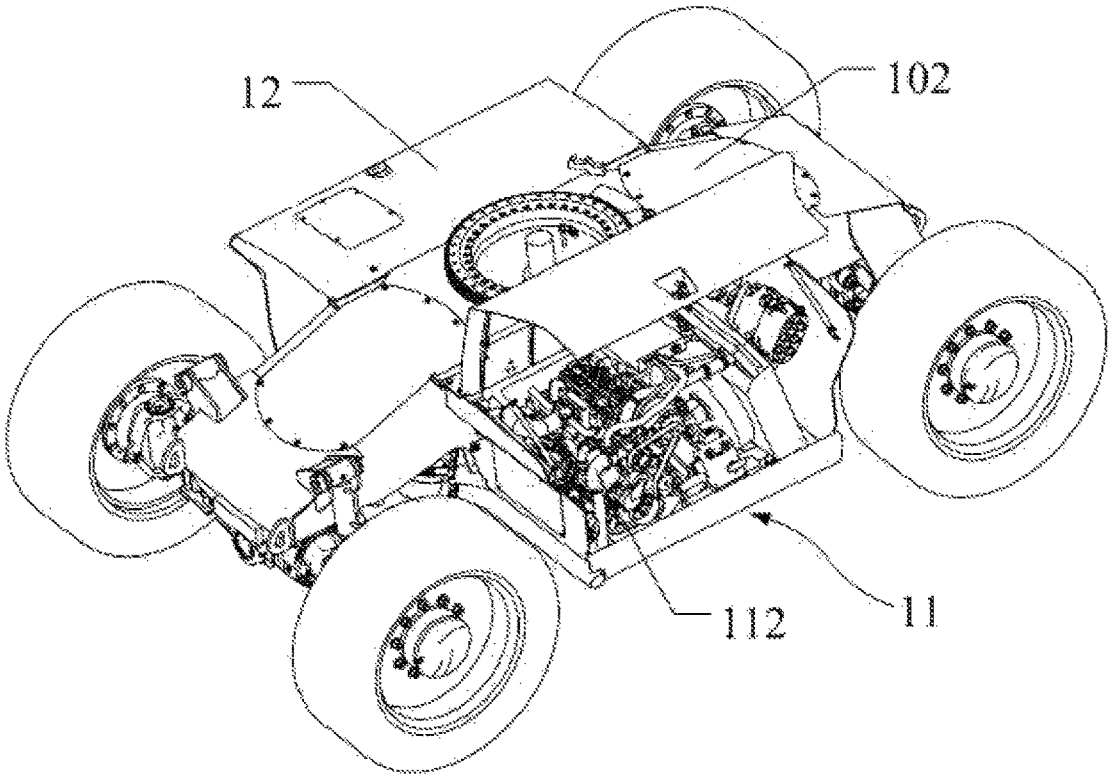
FIG. 4 illustrates another view of the vehicle of FIG. 1 showing internal construction of a first box.
Figure 5:
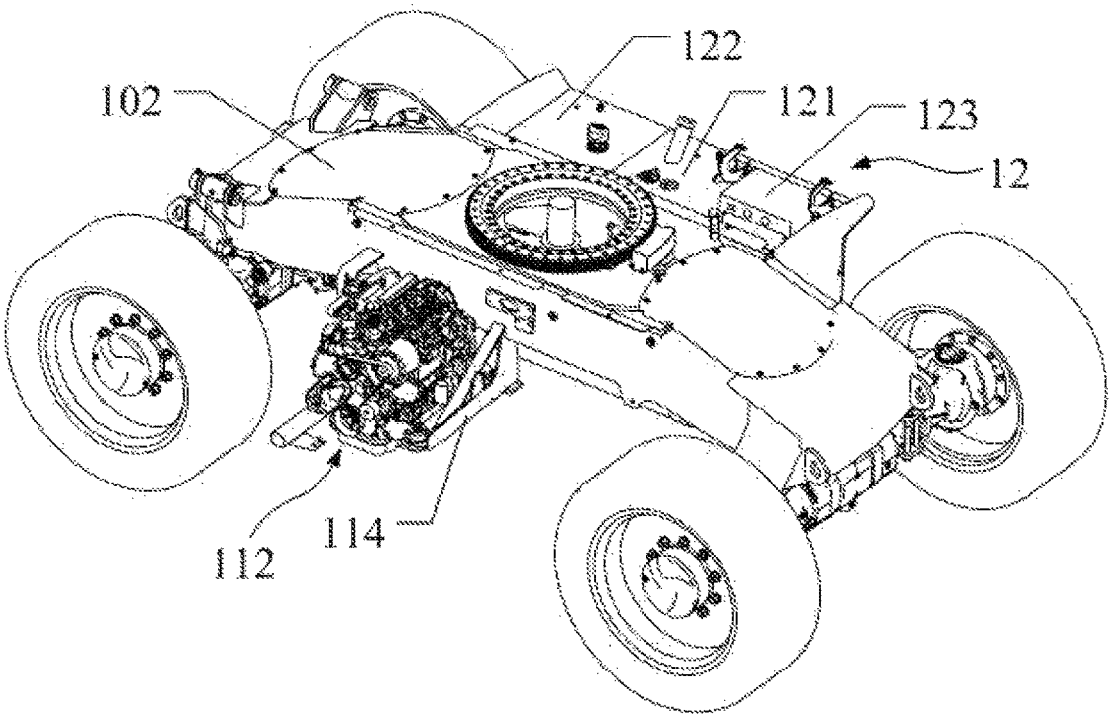
FIG. 5 illustrates another view of the vehicle of FIG. 1 showing internal construction of an engine and second box.
Figure 6:
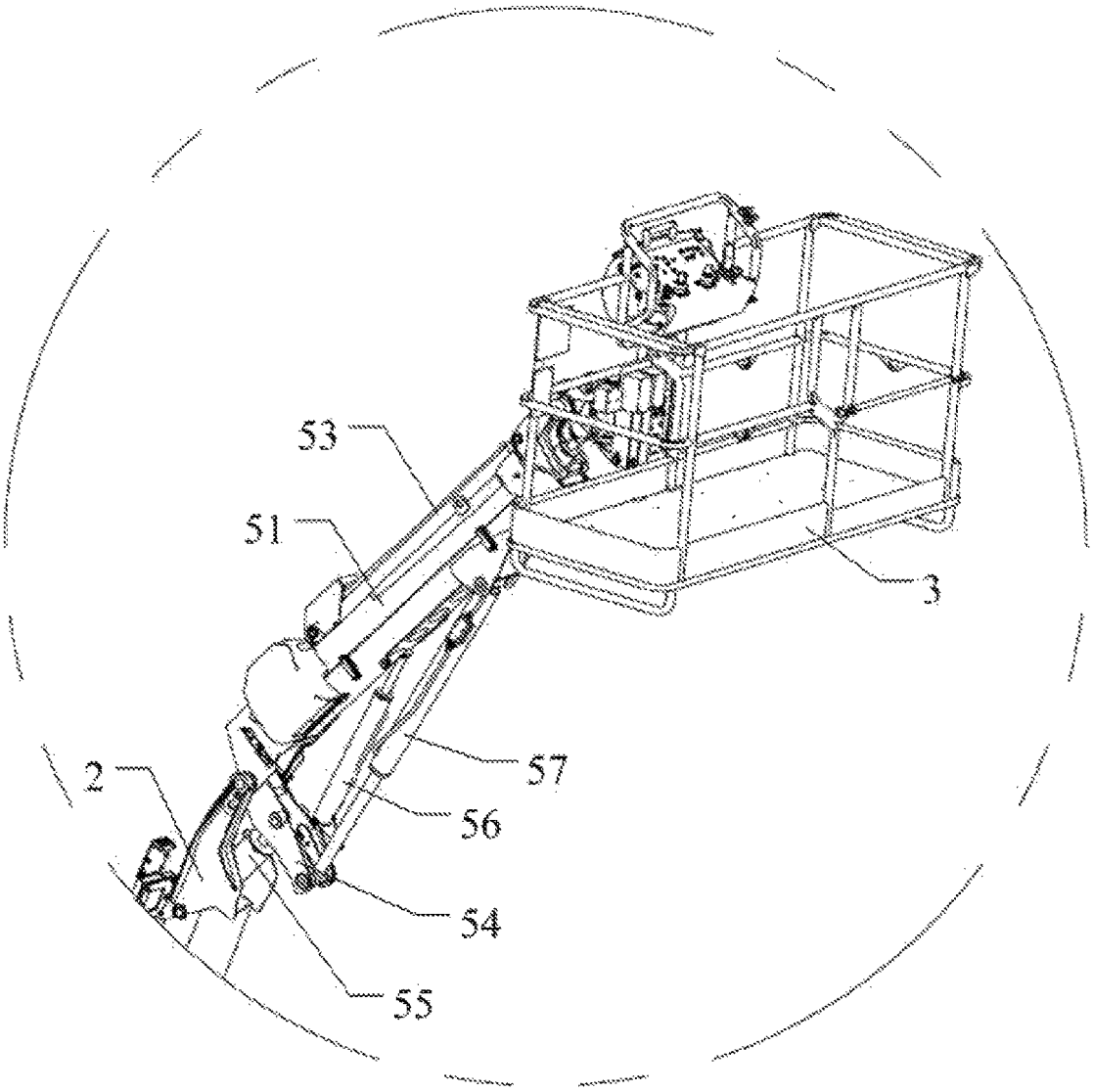
FIG. 6 shows a partially enlarged view of portion M of FIG. 1.
Figure 7:
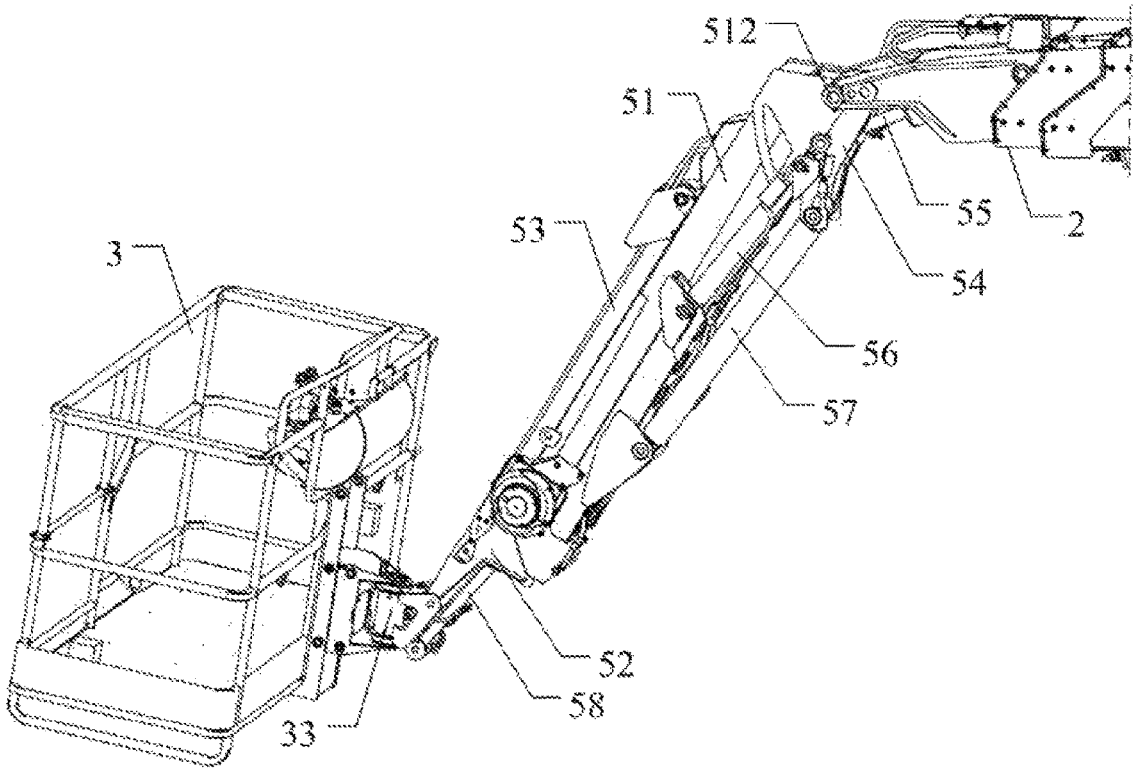
FIG. 7 illustrates another view of a front component of the aerial work platform of FIG. 1, the front component including a telescopic connection component, an operation platform, and relevant connection components.
Figure 8:
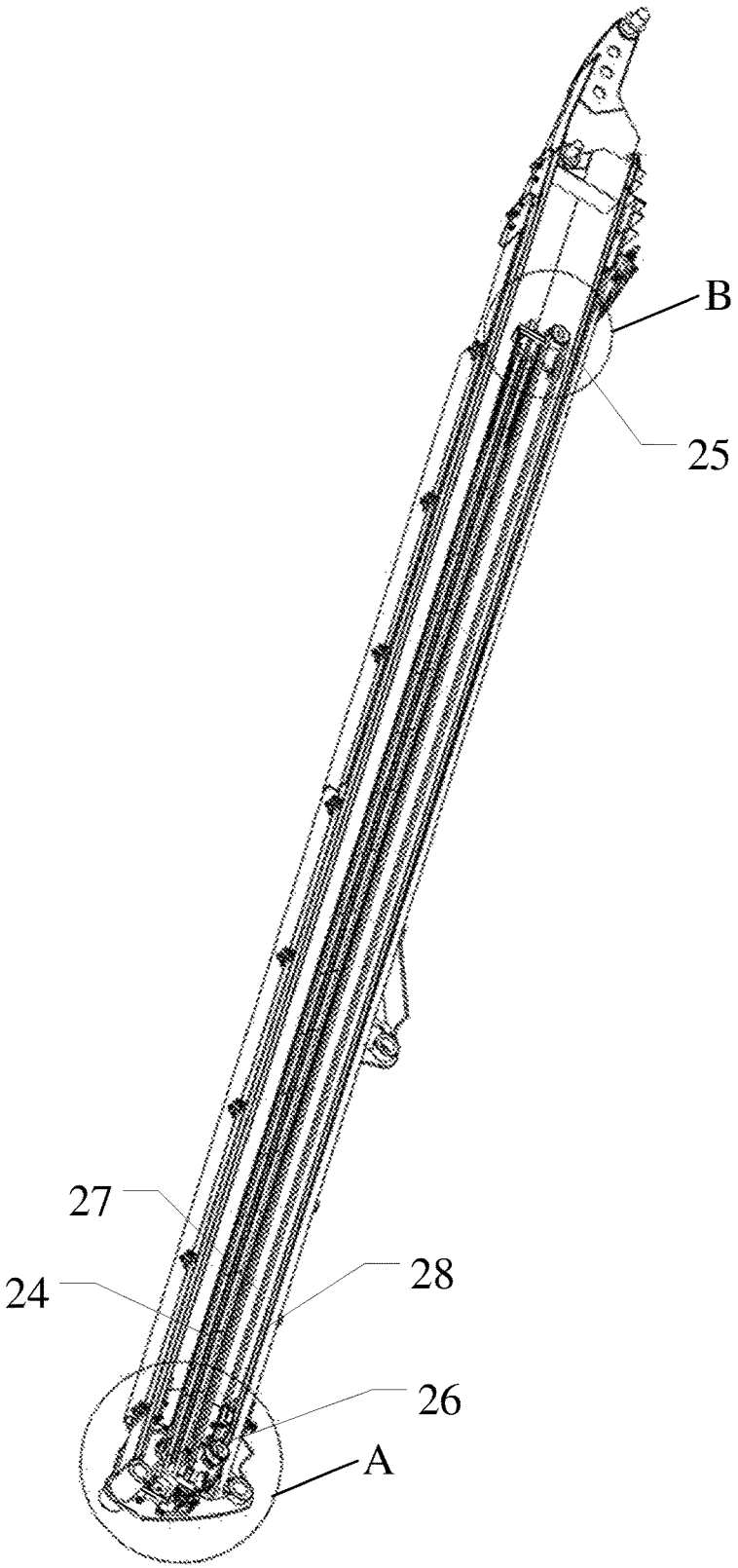
FIG. 8 shows a schematic view of a telescopic transmission component of the aerial work platform of FIG. 1.
Figure 9:
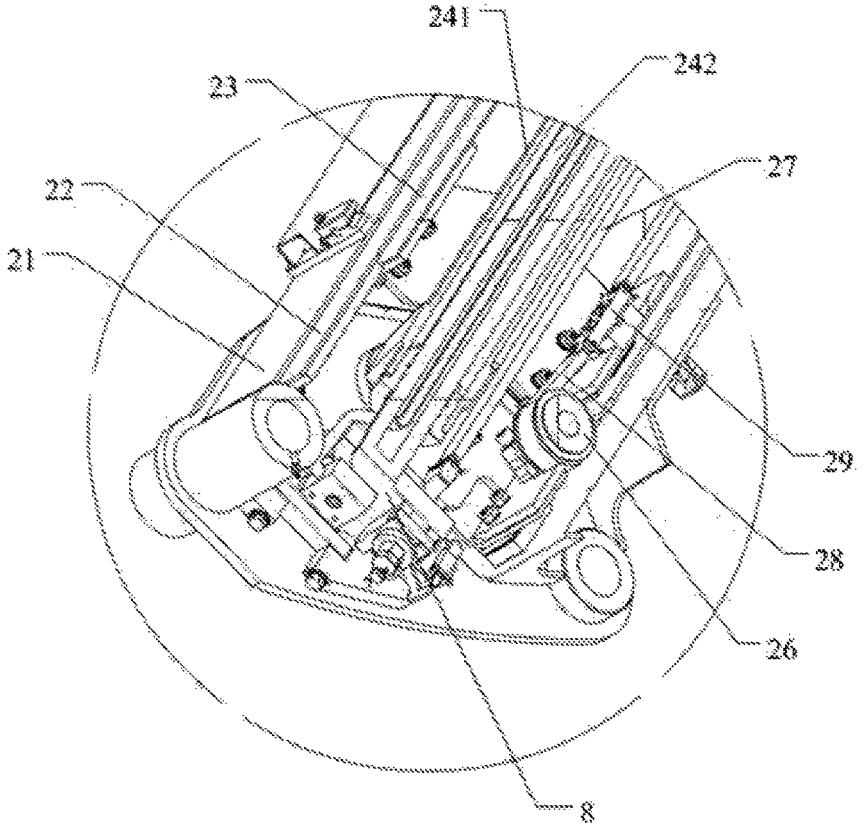
FIG. 9 shows a partially enlarged view of portion A of FIG. 8.
Figure 10:
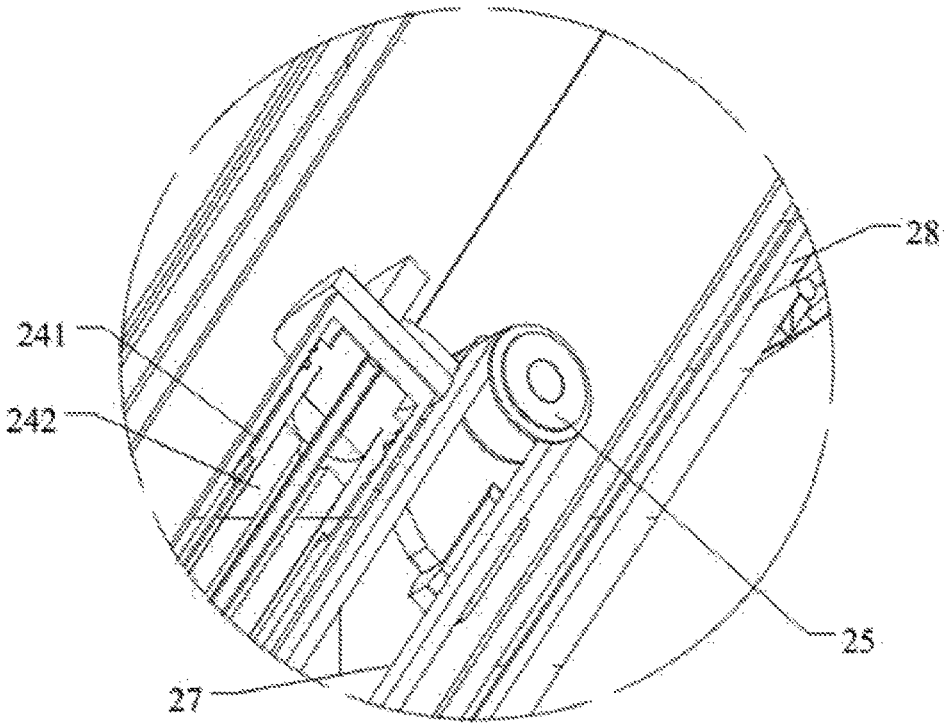
FIG. 10 shows a partially enlarged view of portion B of FIG. 8.

The present invention will be further described below with reference to accompanied drawings and exemplary embodiments. Here, identical numerals represent the identical components. In addition, detailed description of prior art will be omitted if it is unnecessary for illustration of the features of the present invention.

FIGS. 1-16 show a typical embodiment of an aerial work platform of the present invention. The aerial work platform includes a vehicle 1, a telescopic transmission component 2 pivotablly installed on the vehicle 1, and an operation platform 3 connected to a distal end of the telescopic transmission component 2 via a telescopic connection component 5.

It is noted that the vehicle 1 includes a vehicle frame 102, a driving system, a fuel tank 121, and a hydraulic tank 122. The driving system includes a power system, a transmission mechanism, a control system, a driving mechanism, and a wheel assembly. The power system, fuel tank 121 and hydraulic tank 122 are all installed at a side of the frame 102 along a length direction of the frame 102. A turret 101 is provided on an upper end of the frame 102 of the vehicle 1. One end, away from the operation platform 3, of the telescopic transmission component 2, is pivotablly connected with the turret 101 through a supporting arm 4. The operation platform 3 is coupled with the telescopic transmission component 2 by means of a telescopic connection component 5. A supporting member (for example a cylinder with kinds of functions) is disposed between the supporting arm 4 and telescopic transmission component 2, and similarly, another supporting member is placed between the telescopic transmission component 2 and telescopic connection component 5.

Reference is made to FIGS. 1-5. Fixed to two lateral sides of the vehicle frame 102 respectively along its length direction are a first box 11 and a second box 12. The power system is contained in the first box 11, whereas the fuel tank 121 and hydraulic tank 122 are located in the second box 12. The power system includes an engine 112, a cooling component, a fuel delivery component, and an intake-exhaust component. The engine 112 is positioned in the first box 11 and is mounted onto the frame 102 by a bracket 114. A damping device (not shown) is disposed at a location where the engine 112 and bracket 114 are connected together. The fuel tank 121, hydraulic tank 122, and second box 12 are integrally formed. In addition, a control box 123 is disposed on the second box 12 and is foldable into and out of the second box 12. The control box 123 is electrically connected with the control system. Specifically a turning opening is defined at a side of the second box 12 for turning the control box 123 into and out of the second box 12. An upper edge (See orientation of the control box in FIG. 3 of control box 123) is hinged to an upper edge of the turning opening. The height of the control box 123 relative to the ground is such designed that, when the control box 123 is rotated out of the second box 12 through the turning opening, an operator standing on the ground will be able to comfortably get access to the control box 123. In addition, relevant control devices may be provided on the operation platform 3 and be coupled with the control system electrically.

In a summary, as the power system, fuel tank 121, and hydraulic tank 122 are all located at a side of the vehicle frame 102 of the vehicle 1, and the total weight of these and other related components amounts to 1000 Kg-1500 Kg after injection of related materials, the gravity center of the aerial work platform is able to be lowered by 0.4 m-0.6 m, thus strongly improving off-road performance and grade-ability of the entire platform. Accordingly, the aerial work platform is able to run under various complex environments. In addition, the horizontal reach of the aerial work platform is also increased, and work range of the same is also extended.

The telescopic connection component 5 includes an outer arm 51, an inner arm 52 slidably disposed inside the outer arm 51 and capable of being moved out from one end of the outer arm 51, and a forearm telescopic cylinder 53 disposed between the outer arm 51 and inner arm 52.

It is noted that the forearm telescopic cylinder 53 includes a cylinder body (not shown) and a piston rod (not shown) slidably disposed into the cylinder body. Preferably, the cylinder body is secured onto an outer wall of the outer arm 51, and an extension end of the piston rod is secured onto an outer wall of the inner arm 52.

A first levelling cylinder 55 is disposed between the telescopic transmission component 2 and telescopic connection component 5. A forearm head 54 is hinged to one end, which is connected to the telescopic transmission component 2, of the telescopic connection component 5. One end of the first levelling cylinder 55 is hinged to the telescopic transmission component 2, while the other end thereof is hinged to the forearm head 54. The telescopic connection component 5 further includes a forearm luffing cylinder 57 one end of which is hinged to the forearm head 54, while the other end thereof is hinged to the outer wall of the outer arm 51. By this means, the forearm head 54, outer arm 51 and forearm luffing cylinder 57 constitute a triangle luffing mechanism.

It is noted that the forearm head 54, outer arm 51 and telescopic transmission component 2 are hinged together by a pin 512. The first levelling cylinder 55, forearm head 54, forearm luffing cylinder 57 and outer arm 51 constitute a four-bar linkage. Moreover, the first levelling cylinder 55 may operate electrically or hydraulically. In case operating under electric manner, an angle sensor (not shown) matched with the first levelling cylinder 55 is installed on the pin 512 which hinges the forearm head 54, outer arm 51 and telescopic transmission component 2 together. In case operating under hydraulic manner, a hydraulic levelling device matched with the first levelling cylinder 55 is disposed on the telescopic transmission component 2. Preferably, the first levelling cylinder 55 works in electrical levelling manner.

Here, the forearm head 54 may be leveled by pushing and pulling motion of the first levelling cylinder 55 upon the head 54. Specifically, an angle sensor installed on the forearm head 54 sets an angle of the head 54 as zero. During luffing of the telescopic transmission component 2, the forearm head 54 will tilt accordingly. As a result, angle signal of the forearm head 54 will be sent to a corresponding controller through the angle sensor. After receiving the signal, the controller will generate a corresponding command to cause telescopic motion of the first levelling cylinder 55, thereby realizing levelling of the forearm head 54. In other words, the forearm head 54 is controlled to be oriented at its predefined zero angle. In addition, up and down luffing of the telescopic connection component 5 may also be realized by telescopic movement of the forearm luffing cylinder 57.

Furthermore, a third levelling cylinder 58 is disposed between the telescopic connection component 5 and operation platform 3. One end of the third levelling cylinder 58 is hinged to the inner arm 52, whereas the other end thereof is hinged to a rotary cylinder 33 secured onto the operation platform 3.

Preferably, a second levelling cylinder 56 is positioned between the forearm head 54 and telescopic connection component 5. One end of the second levelling cylinder 56 is hinged to the forearm head 54, while the other end thereof is hinged to the outer wall of the outer arm 51. A cavity of the second levelling cylinder 56 communicates with a cavity of the third levelling cylinder 58 by means of an oil tube.

It is noted that arrangement of the second levelling cylinder 56 and third levelling cylinder 58 avoids tilting of the operation platform 3 during luffing of the telescopic connection component 5. In other words, the operation platform 3 is always maintained at a horizontal location during luffing of the telescopic connection component 5. Accordingly, the second levelling cylinder 56 and third levelling cylinder 58 have a second level of levelling function (the first levelling cylinder 55 and associated device realize a first level of levelling function). As the cavity of the second levelling cylinder 56 communicates with that of the third levelling cylinder 58 by an oil tube, levelling may be achieved by adjusting telescopic motion of the second and third levelling cylinders 56 and 58. The detailed levelling processing is described below. When the telescopic connection component 5 luffs upwardly, a telescopic rod of the forearm luffing cylinder 57 comes out and at the same time, a telescopic rod of the second levelling cylinder 56 also comes out. At this time, hydraulic medium inside a rod chamber of the second levelling cylinder 56 flows under pressure into a rod chamber of the third levelling cylinder 58. Next, a telescopic rod of the third levelling cylinder 58 retracts, and hydraulic medium contained inside the non-rod chamber of the third levelling cylinder 58 flows into a non-rod chamber of the second levelling cylinder 56 through an oil tube so as to realize levelling by balancing pressure inside relevant chambers of the second and third levelling cylinders 56 and 58. This principle also applies when the telescopic connection component 5 luffs downwardly except for flowing direction of hydraulic medium and movement direction of relevant components. Here, cross section areas of the cylinders, telescopic rods of the second and third levelling cylinders 56 and 58, and traveling distances of the telescopic rods thereof are predefined and matched among each other.

Reference is made to FIGS. 1 and 6-16 illustrating a typical embodiment of a telescopic transmission component of the aerial work platform of the invention. The telescopic transmission component 2 includes a base arm 21, a second arm 22, a third arm, a telescopic cylinder 24, a rope-expanding chain 27, and a rope-retracting chain 28.

Figure 11:
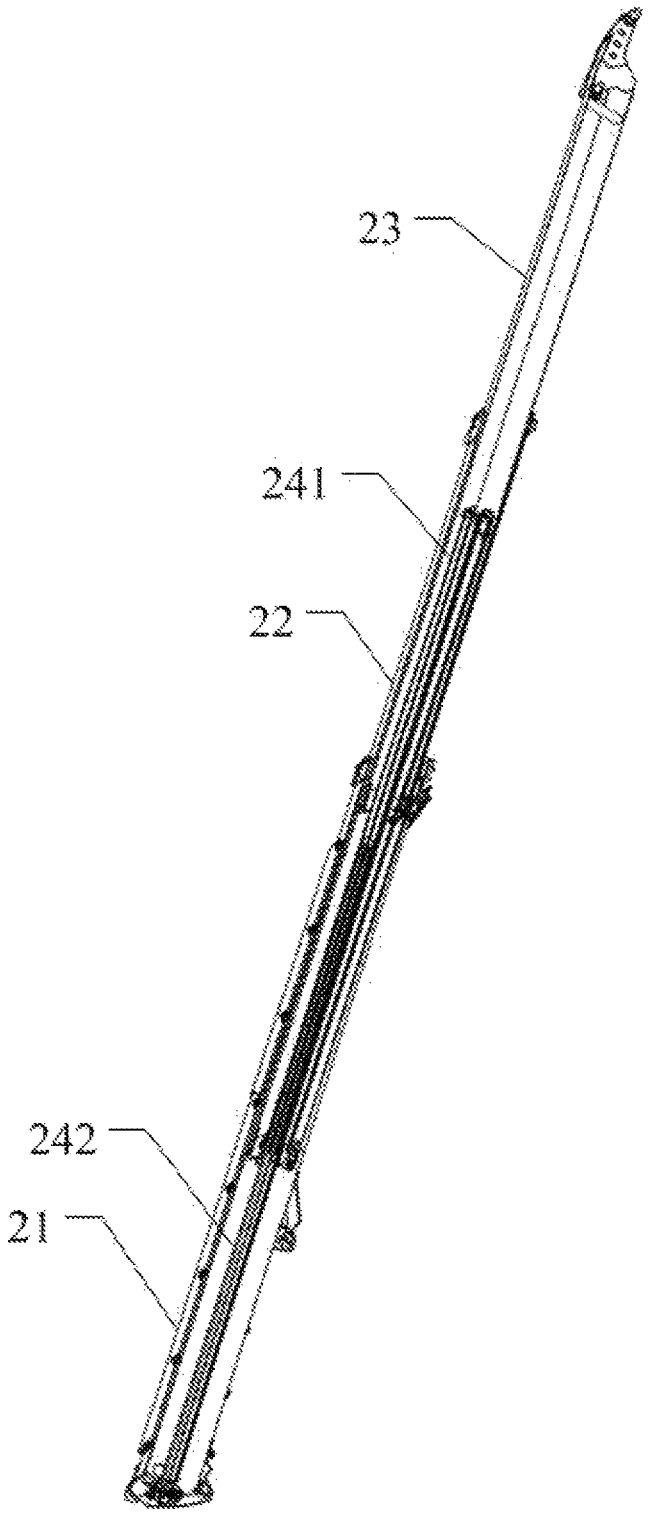
FIG. 11 shows a view of the telescopic transmission component of FIG. 8 in an expanded configuration.
Figure 12:
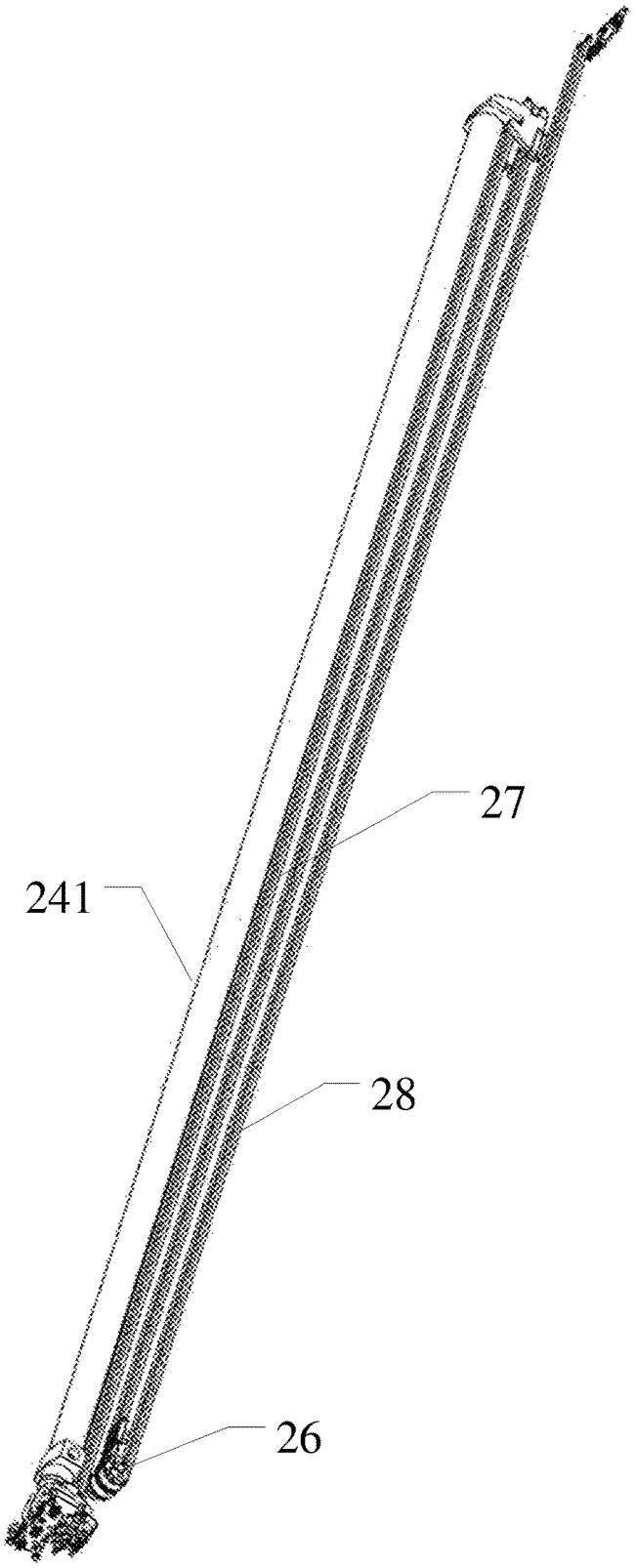
FIG. 12 denotes a structural view of internal major transmission members of the telescopic transmission component of FIG. 8, the major transmission members including a first sprocket wheel, a second sprocket wheel, a rope-expanding chain, a rope-retracting chain, and a retractable cylinder.
Figure 13:
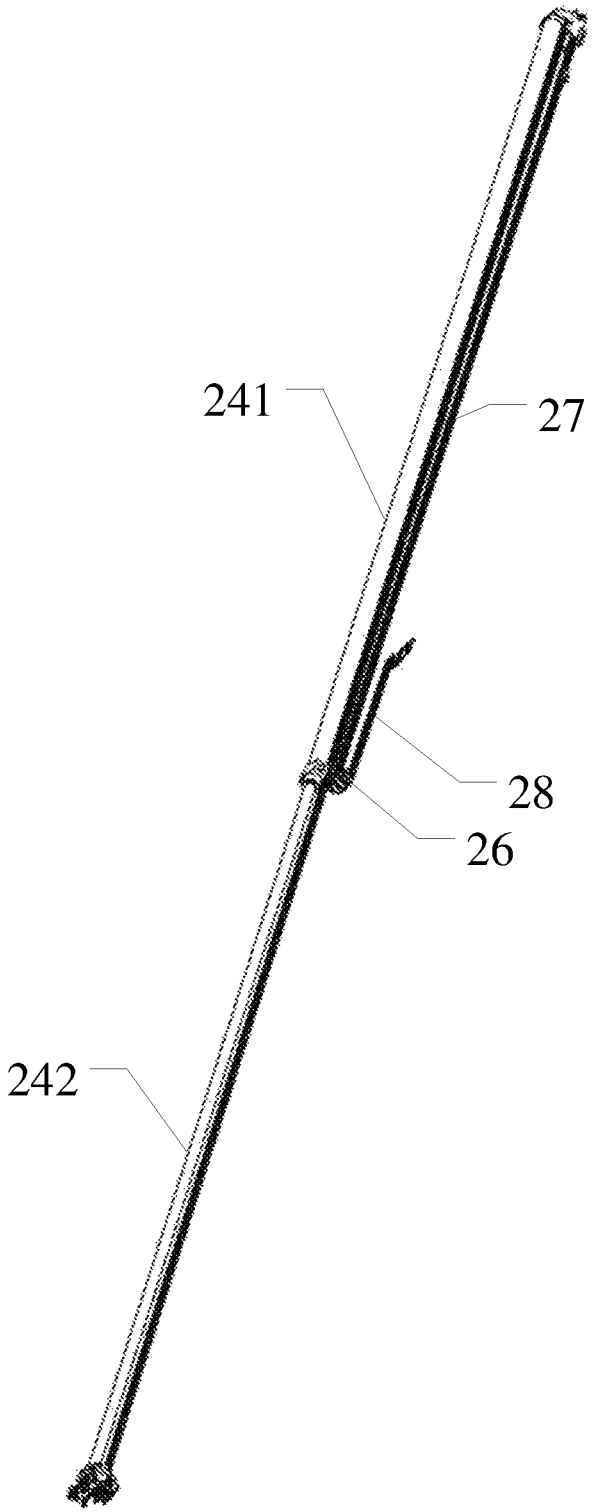
FIG. 13 shows a schematic view of internal major transmission members of the telescopic transmission component of FIG. 8.
Figure 14:
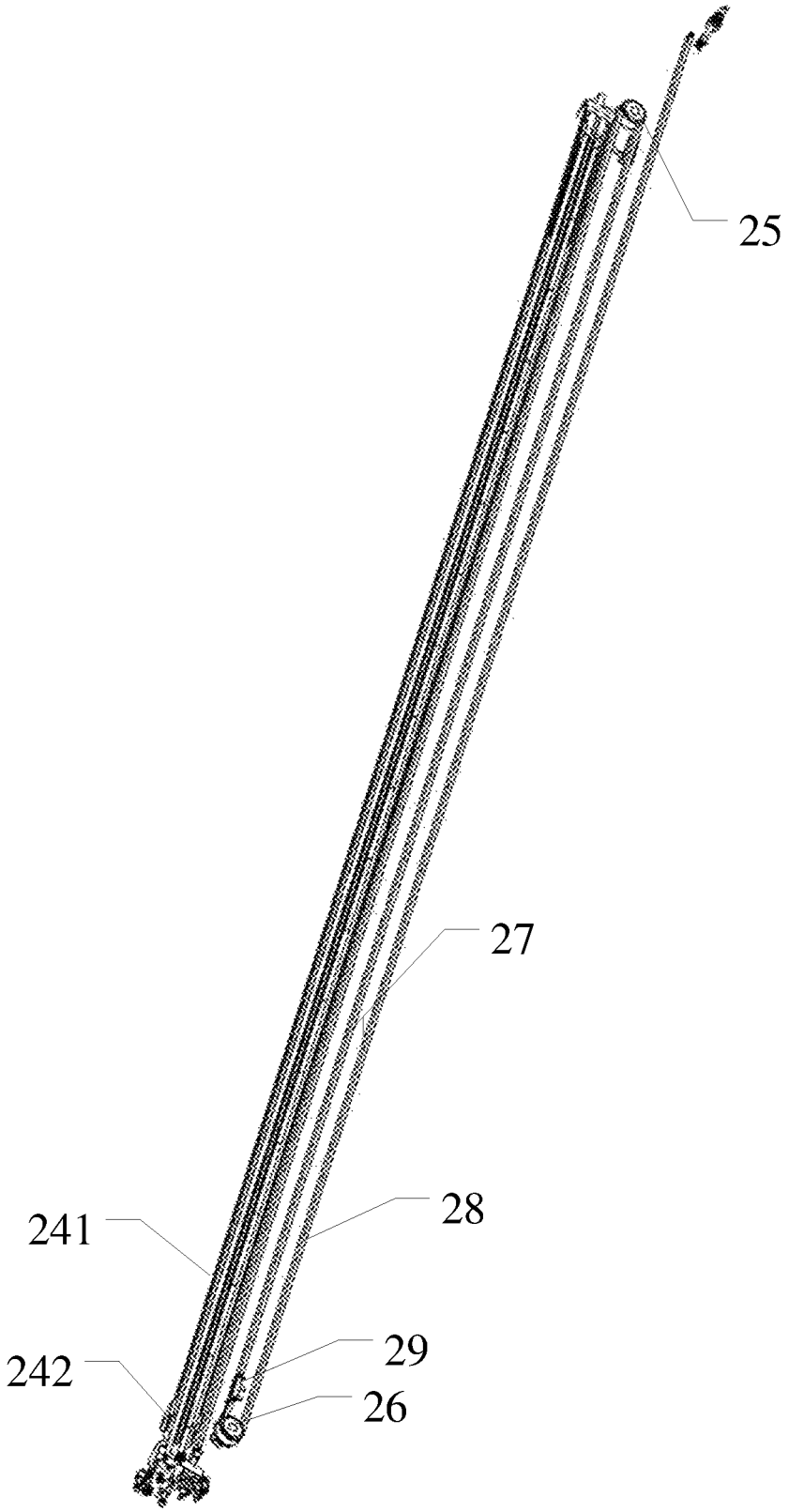
FIG. 14 shows a schematic view of internal major transmission members of the telescopic transmission component of FIG. 8.

The second arm 22 is inserted into the base arm 21 and is able to move out of the base arm 21 (See an upper portion of FIG. 11). The third arm 23 is inserted into the second arm 22 and is capable of coming out of an extension end of the same (See an upper portion of FIG. 11).

The telescopic cylinder 24 includes a cylinder barrel 241 secured onto the second arm 22 and a telescopic rod 242 inserted into the barrel 241. The telescopic rod 242 has a hollow arrangement 247 communicating with a cavity of the cylinder barrel 241. An oil guiding tube 245 is provided into the hollow arrangement 247 of the telescopic rod 242, and the extension end of the telescopic rod 242 is secured onto the base arm 21 (See a lower portion of FIG. 13). Preferably, an end surface of the extension end of the telescopic rod 242 is fixed to the base arm 21 through a mounting plate 8. A connection portion is provided on the cylinder barrel 241 at a location adjacent to the extension end of the telescopic rod 242 for securing the barrel 241 to the second arm 22. The connection portion may in the form of an axle hole. That is, the cylinder barrel 241 may be mounted on the second arm 22 by inserting a pin into said axle hole. Of course, the connection portion of the barrel 241 may also be designed to locate at other positions of the barrel 241, for example at a middle position.

Moreover, a first sprocket wheel 25 is provided on the telescopic cylinder 24, a second sprocket wheel 26 is provided on the second arm 22, and the second sprocket wheel 26 is closer to the extension end of the cylinder barrel 241 than does the first sprocket wheel 25. One end of the rope-expanding chain 27 is attached onto the base arm 21, while the other end thereof runs around the first sprocket wheel 25 and then is attached onto the third arm 23. In other words, the two ends of the rope-expanding chain 27 are both located below the first sprocket wheel 25 (See orientation of figures). One end of the rope-retracting chain 28 is attached onto the third arm 23, while the other end thereof runs around the second sprocket wheel 26 and then is attached onto the base arm 21. In other words, the two ends of the rope-retracting chain 28 are both located above the second sprocket wheel 26 (See orientation of figures). Preferably, the first sprocket wheel 25 is located on a cylinder head, which cylinder head is located at one end away from an extension end, of the telescopic cylinder 24. The second sprocket wheel 26 is located on the second arm 22 at a location adjacent to the extension end of the telescopic rod 242. By this manner, the first and second sprocket wheels 25 and 26 are capable of being positioned above and below the cylinder barrel 241 (See orientation of figures). This ensures stable movement of the cylinder barrel 241 and accordingly, it also ensures stable rotation and telescopic motion of relevant components. Of course, the first and second sprocket wheels 25 and 26 may also be positioned at other suitable locations. For instance, the first sprocket wheel 25 may be located at a middle area of the cylinder barrel 241, and the second sprocket wheel 26 may be placed on the second arm 22 at a location close to a middle portion of the cylinder barrel 241.

Figure 15:
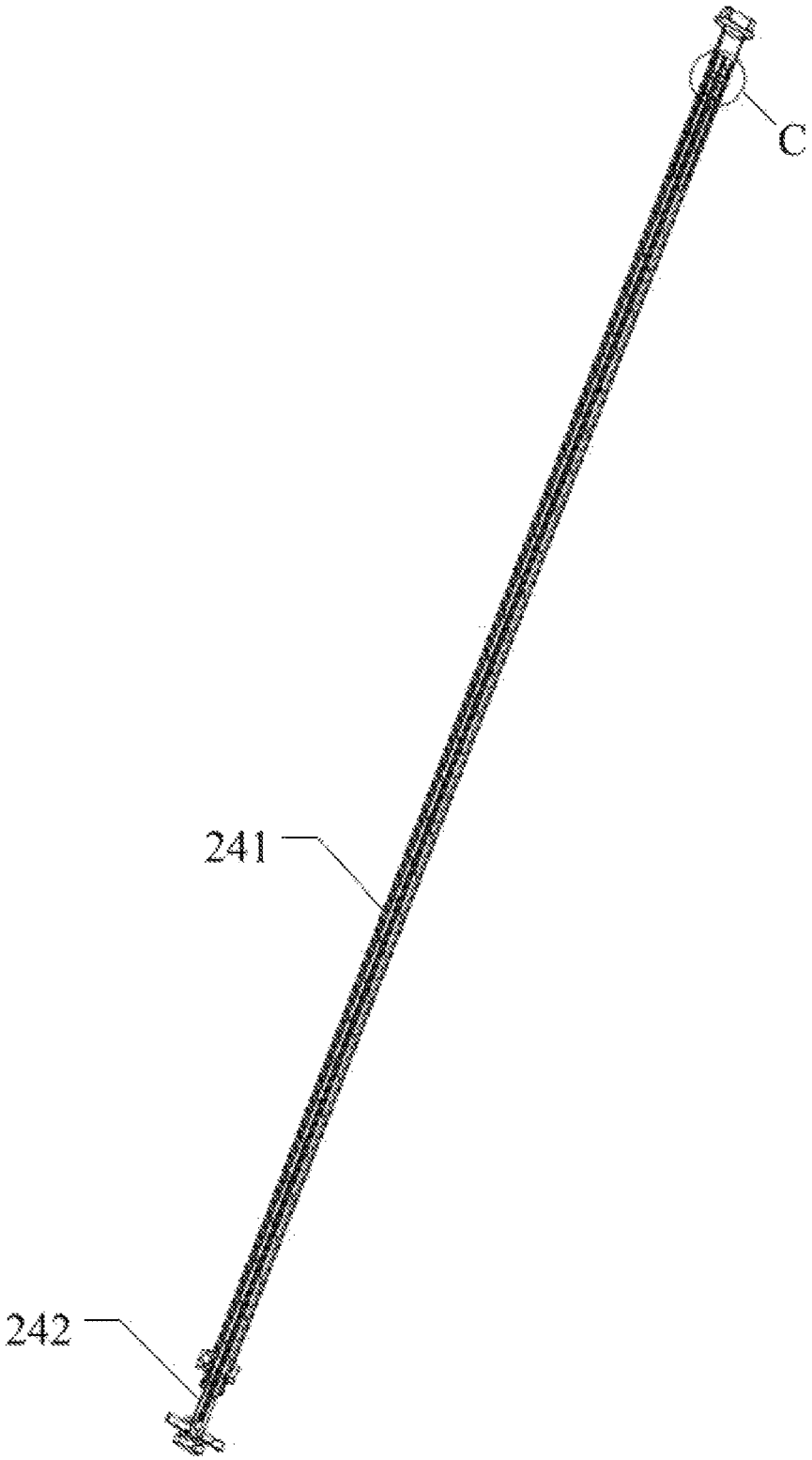
FIG. 15 denotes a structural view of the retractable cylinder of the telescopic transmission component of FIG. 8.
Figure 16:
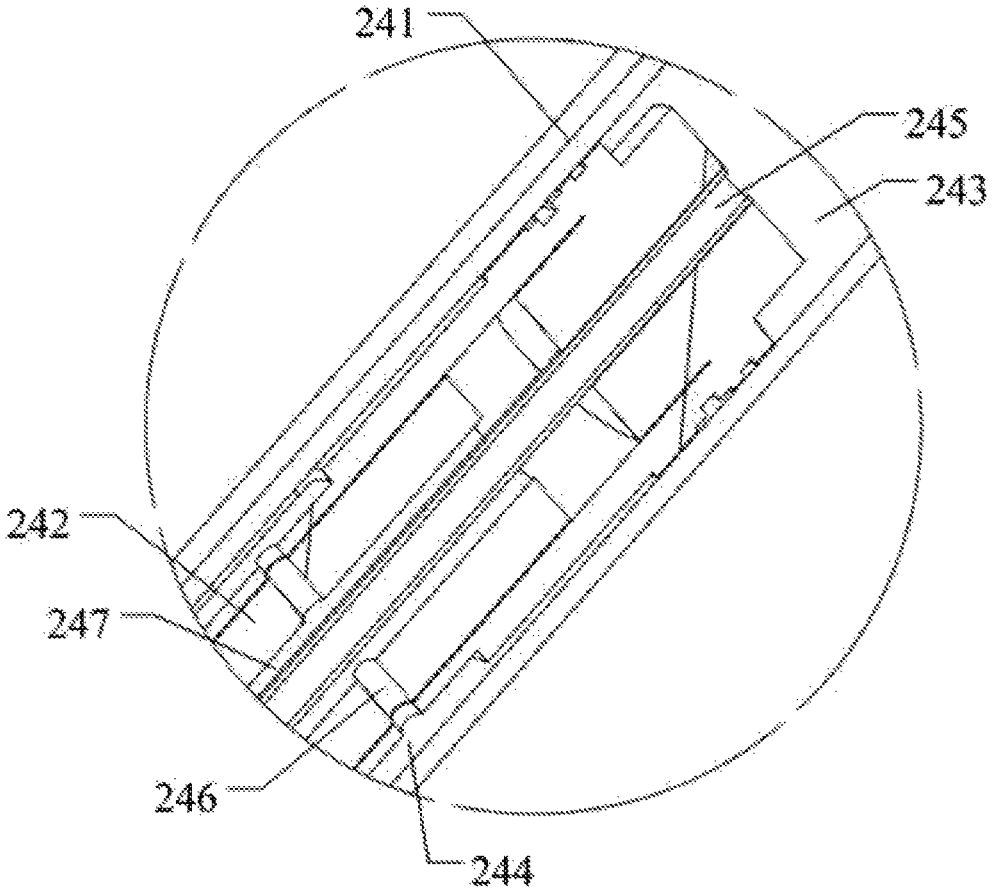
FIG. 16 shows a partially enlarged view of portion C of FIG. 15.

As shown in FIGS. 15-16, an inner cavity of the cylinder barrel 241 of the telescopic cylinder 24 is separated to form a rod chamber 244 and a non-rod chamber 243. In other words, partial space of the inner cavity of the barrel 241 overlaps the telescopic rod 242 and thus forms the rod chamber 244. Partial space of the inner cavity of the barrel 241 doesn't overlap the rod 242 and locates at a upper right side (See FIG. 16) of a distal end of the telescopic rod, and accordingly, forms the non-rod chamber 243. The hollow arrangement 247 of the telescopic rod 242 communicates with the rod chamber 244 via a connection path 246. The hollow arrangement 247 of the rod 242 together with the oil guiding tube 245 inside the arrangement 247 is communicated with an external oil tube.

Furthermore, one end of the rope-retracting chain 28 is attached onto the third arm 23 by means of a chain connection member 29, similarly, one end of the rope-expanding chain 27 is also attached onto the third arm 23 by means of the chain connection member 29, and the two ends are located at two sides of the chain connection member 29. By this manner, motions of the rope-expanding chain 27, rope-retracting chain 28 and third arm 23 are coordinated among each other. Alternatively, the rope-expanding chain 27 and rope-retracting chain 28 may be connected to the third arm 23 with different connective members.

Moreover, a chain detection device is provided on the rope-expanding chain 27 for real time detecting status of related chain. When a chain is broken or exceeds a predefined loose value, the chain detection device will generate alert signals to guarantee safety of the telescopic transmission component 2, and further guarantee safety of operators and other staff. In particular, the chain detection device may be disposed on the rope-expanding chain 27 at one end thereof where the chain 27 is connected to the base arm 21.

Preferably, all of the base arm 21, second arm 22 and third arm 23 are of hollow arrangement. It is noted that these arms are by no means limited to this hollow arrangement, and in fact they may be of other constructions.

Furthermore, these hollow arrangements of the base arm 21, second arm 22 and third arm 23 form a telescopic cavity into which the telescopic cylinder 24, first sprocket wheel 25, second sprocket wheel 26, rope-expanding chain 27 and rope-retracting chain 28 are received, thus leading to a compact structure for the telescopic transmission component 2, and further reducing wear and aging of the components, thereby extending lifetime. This also reduces repair and maintenance frequency and makes it more convenient to repair and maintain the same, thus decreasing related costs. In addition, to certain extent these components are not exposed outside and accordingly, risk of operators being injured due to unintentional collision with the components is also reduced. Of course, it is also feasible to place the telescopic cylinder 24, first sprocket wheel 25, second sprocket wheel 26, rope-expanding chain 27 and rope-retracting chain 28 outside the telescopic cavity (that is, place them onto the outer walls of the base arm 21, second arm 22 and third arm 23).

In a summary, as the telescopic rod 242 is secured onto the base arm 21, when driven by suitable liquid medium, the cylinder barrel 241 will move upwardly together with the second arm 22 such that the second arm 22 will move out of the base arm 21. In turn, under the traction of the rope-expanding chain 27 and first sprocket wheel 25, the third arm 23 is pulled to move out of an upper end of the second arm 22. With continuous injection of the liquid medium into the cylinder barrel 241, the second arm 22 and third arm 23 will continue to move toward the upper end until desired travel distance or maximum predefined distance is reached. During this movement, the first sprocket wheel functions as a movable pulley, and in this situation, displacement of the third arm 23 relative to the base arm 21 is two times as long as a travel distance of the cylinder barrel 241 (the distance of the second arm 22 with respect to the base arm 21). In this case, telescopic distance is certainly extended.

When oil enters the rod chamber 244 of the cylinder barrel 241 through the hollow arrangement 247 of the telescopic rod 242, the barrel 241 will drive the second arm 22 to move together downwardly such that the second arm 22 will retract from the upper end of the base arm 21. In turn, the third arm 23 will retract into the second arm 22 when driven by the rope-retracting chain 28 and second sprocket wheel 26. With continuous oil injection into the telescopic rod 242, the second arm 22 and third arm 23 will continuously retract towards a low end until a desired retracting location or complete retracting location is reached. During this retraction, the second sprocket wheel 26 works as a movable pulley such that the displacement of the third arm 23 relative to the base arm 21 is two times as long as the travel distance of the cylinder barrel 241 (that is, the distance of the second arm 22 relative to the base arm 21).

Specifically, please refer to FIG. 1 and other related figures, the third arm 23 is hinged to the operation platform 3 by said telescopic connection component 5. In other words, the third arm 23 is hinged to the outer arm 51 of the telescopic connection component 5, and the inner arm 52 of the component 5 is connected with the operation platform 3. The telescopic connection component 5 helps the operation platform 3 move further along a horizontal direction. The base arm 21 is hinged to the vehicle 1 by the supporting arm 4 which is movably connected with relevant component of the vehicle 1. In addition, a luffing cylinder 6 is disposed between the base arm 21 and supporting arm 4. By this manner, the base arm 21, supporting arm 4 and luffing cylinder 6 connected therewith also together define a reliable triangle construction. This makes sure that the aerial work platform bears more stability and security.

When the aerial work platform requires extending its arms, the second and third arms 22, 23 are controlled to extend of the telescopic transmission component 2. At this time, the operation platform 3 coupled with the telescopic transmission component 2 will also be extended when driven by the third arm 23. At this time, relevant cylinder 6, supporting arm 4 and telescopic connection component 5 are also controlled to adjust angle or location of relevant arms until the operation platform 3 moves to a predefined working location or a maximum extension distance is reached.

Similarly, when the aerial work platform requires withdrawing its arms, the second and third arms 22, 23 of the telescopic transmission component 2 are controlled to retract. At this time, the operation platform 3 coupled with the telescopic transmission component 2 will also be retracted when driven by the third arm 23. At this time, relevant cylinder 6, supporting arm 4 and telescopic connection component 5 are also controlled to adjust angle or location of relevant arms until the operation platform 3 moves to a predefined working location or returns to its original location without extension.

Figure 17:
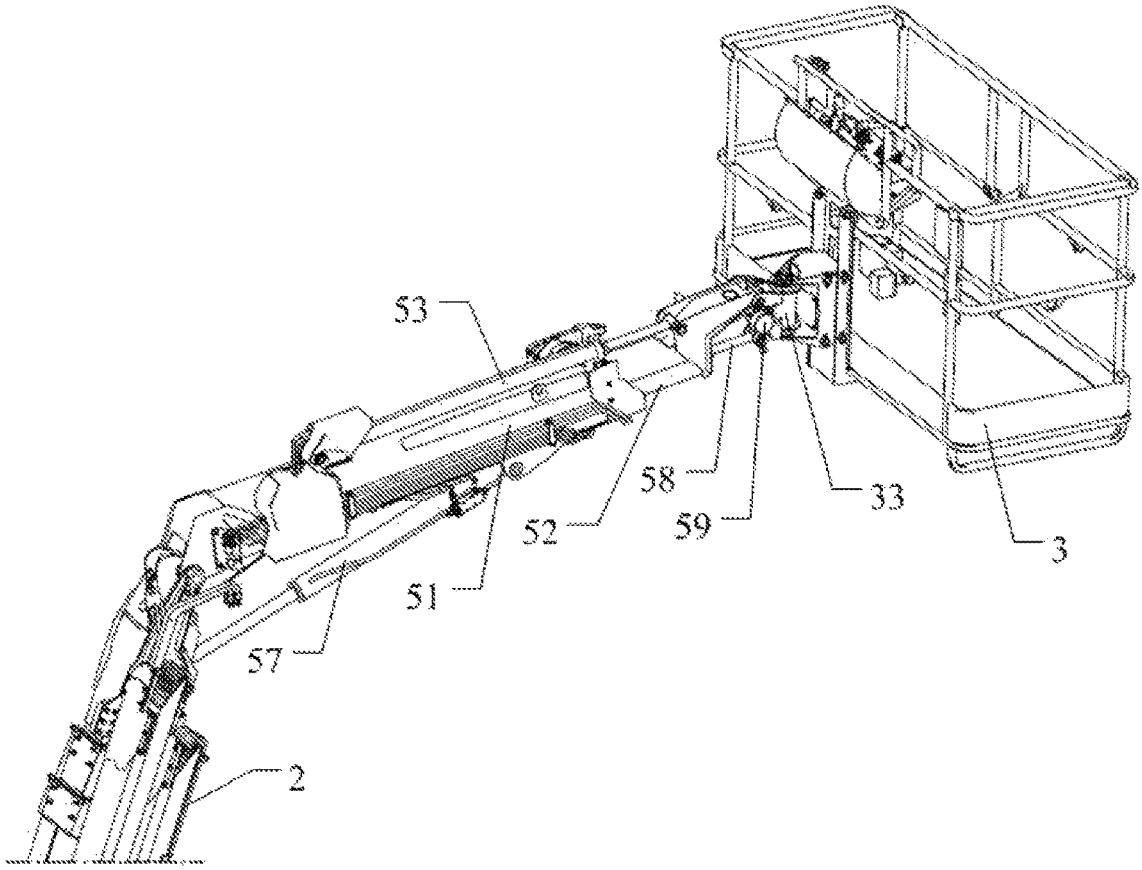
FIG. 17 illustrates a view of a front component of an aerial work platform according to another embodiment of the invention.

Moreover, please refer to FIG. 17 which illustrates another example of an aerial work platform of the invention. This example is different from the above example in that: a luffing cylinder 57 in place of relevant first level of levelling components of the above example and serving as a supporting member is disposed between the telescopic transmission component 2 and telescopic connection component 5; and the third levelling cylinder 58 works in an electrical levelling manner other than hydraulic levelling manner as described in above example, that is, an angle sensor 59 cooperating with the third levelling cylinder 58 is provided on the rotary cylinder 33.

When in operation, up and down luffing action of the telescopic connection component 5 is realized by telescopic motion of the luffing cylinder 57 located between the telescopic transmission component 2 and telescopic connection component 5. Levelling of the operation platform is conducted by telescopic motion of the third levelling cylinder 58, thus ensuring all time horizontal orientation of the platform.

Specifically, an angle sensor 59 installed on the rotary cylinder 33 sets a location of the operation platform 3 as zero. During luffing motion of the telescopic connection component 5, this angle sensor 59 will transmits electrical signals to a corresponding controller which when receives the signals, will send control command to cause telescopic motion of the third levelling cylinder 58, hence realizing levelling of the operation platform. in other words, it is maintained that the operation platform is always in its zero location.

Summarily, the inventive aerial work platform has better off-road performance and grade-ability, can work in complicated environment, and owns a longer horizontal reach and larger working range (it is extended by at least 1.2 meters than a prior art aerial work platform). Moreover, maintenance and repair cost is decreased, lifetime is extended, integrity is higher and appearance looks better.

Though various embodiments of the present invention have been illustrated above, a person of the art will understand that, variations and improvements made upon the illustrative embodiments fall within the scope of the present invention, and the scope of the present invention is only limited by the accompanying claims and their equivalents.

The invention claimed is:

1. A vehicle with a low gravity center for an aerial work platform comprising, a vehicle frame, a power system, a fuel tank, and a hydraulic tank all of which are mounted at a side of the vehicle frame;

wherein the power system, fuel tank, and hydraulic tank are all disposed at a side of the vehicle frame along a length direction;

wherein a first box and a second box are installed on two sides of the vehicle frame along the length direction of the vehicle frame respectively; and the power system is contained in the first box, whereas the fuel tank and hydraulic tank are contained in the second box; and wherein a control box is disposed on the second box and is foldable into and out of the second box.

2. The vehicle with a low gravity center as recited in claim 1, wherein the power system includes an engine located in the first box and secured onto the vehicle frame through a bracket.

3. The vehicle with a low gravity center as recited in claim 1, wherein the fuel tank, hydraulic tank, and second box are integrally formed.

4. An aerial work platform comprising, a vehicle with lower gravity center, the vehicle including a vehicle frame, a power system, a fuel tank, and a hydraulic tank all of which are mounted at a side of the vehicle frame; a telescopic transmission component pivotablly mounted on the vehicle, and an operation platform disposed on a distal end of the telescopic transmission component;

wherein the power system, fuel tank, and hydraulic tank are all disposed at a side of the vehicle frame along a length direction;

wherein a first box and a second box are installed on two sides of the vehicle frame along the length direction of the vehicle frame respectively; and the power system is contained in the first box, whereas the fuel tank and hydraulic tank are contained in the second box; and wherein a control box is disposed on the second box and is foldable into and out of the second box.

5. The aerial work platform as recited in claim 4, wherein a turret is disposed on the vehicle frame of the vehicle; one end, away from the operation platform, of the telescopic transmission component, is pivotably connected with the turret through a supporting arm; the operation platform is connected with the telescopic transmission component via a telescopic connection component.

* * * * *